US007100786B2

(12) United States Patent
Smyers

(10) Patent No.: US 7,100,786 B2
(45) Date of Patent: Sep. 5, 2006

(54) COLLAPSIBLE CONTAINER

(75) Inventor: Justin M. Smyers, Redondo Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 148 days.

(21) Appl. No.: 10/393,863

(22) Filed: Mar. 21, 2003

(65) Prior Publication Data

US 2004/0182858 A1 Sep. 23, 2004

(51) Int. Cl.
*B65D 6/12* (2006.01)
*B65D 6/16* (2006.01)

(52) U.S. Cl. ..... 220/7; 220/6

(58) Field of Classification Search ..... 220/6, 220/7, 840
See application file for complete search history.

(56) References Cited

U.S. PATENT DOCUMENTS

| | | | | |
|---|---|---|---|---|
| 2,760,669 | A | 8/1956 | Kreutzer | |
| 3,360,180 | A | 12/1967 | Venturi | |
| 3,446,415 | A | 5/1969 | Bromley | |
| 3,874,546 | A | 4/1975 | Sanders et al. | |
| 4,591,065 | A | 5/1986 | Foy | |
| 4,917,255 | A | 4/1990 | Foy et al. | |
| 4,940,155 | A * | 7/1990 | Hewson | 220/6 |
| 4,960,223 | A | 10/1990 | Chiang et al. | |
| 5,048,715 | A * | 9/1991 | Wolff | 220/832 |
| 5,094,356 | A * | 3/1992 | Miller | 220/7 |
| 5,398,834 | A | 3/1995 | Umiker | |
| 5,398,835 | A | 3/1995 | Blinstrub | |
| 5,467,885 | A | 11/1995 | Blinstrub | |
| 5,515,987 | A | 5/1996 | Jacques et al. | |
| 5,586,675 | A | 12/1996 | Borsboom et al. | |
| 5,588,549 | A | 12/1996 | Furtner | |
| 5,797,508 | A | 8/1998 | Loftus et al. | |
| 6,015,056 | A | 1/2000 | Overholt | |
| 6,029,840 | A | 2/2000 | Brauner | |
| 6,098,827 | A | 8/2000 | Overholt et al. | |
| 6,142,329 | A | 11/2000 | Dotan | |
| 6,209,742 | B1 | 4/2001 | Overholt et al. | |
| 6,286,701 | B1 * | 9/2001 | Umiker | 220/6 |
| 6,293,418 | B1 | 9/2001 | Ogden et al. | |
| 6,386,388 | B1 | 5/2002 | Overholt | |
| 6,398,054 | B1 | 6/2002 | Overholt et al. | |
| 6,405,888 | B1 | 6/2002 | Overholt et al. | |
| 6,409,041 | B1 | 6/2002 | Overholt et al. | |
| 6,460,717 | B1 | 10/2002 | Smyers et al. | |
| 6,631,822 | B1 | 10/2003 | Overholt | |
| 2002/0108950 | A1 | 8/2002 | Moorman et al. | |
| 2003/0132228 | A1 | 7/2003 | Apps et al. | |

FOREIGN PATENT DOCUMENTS

| | | |
|---|---|---|
| DE | 1536040 | 12/1969 |
| DE | 91 03 975.4 | 3/1991 |
| EP | 0 073 357 A2 | 3/1983 |
| EP | 0 211 116 A2 | 2/1987 |
| EP | 0 690 003 | 1/1990 |

(Continued)

*Primary Examiner*—Nathan J. Newhouse
*Assistant Examiner*—Harry Grosso

(57) ABSTRACT

A collapsible crate includes an improved hinge for connecting side walls to the base. The improved hinge includes a hinge member and a hinge receiver. The hinge receiver includes a pair of deformable tangs each having an opening. The hinge receiver includes a hinge pin having a pair of axial ends, each extending into the opening of the tang. Each axial end of the pin includes a tapered portion, which facilitates insertion of the hinge pin into the hinge receiver.

41 Claims, 10 Drawing Sheets

FOREIGN PATENT DOCUMENTS

| | | |
|---|---|---|
| EP | 0 785 142 A1 | 7/1997 |
| EP | 1 114 779 | 7/2001 |
| FR | 1040163 | 10/1953 |
| GB | 2 337 985 A | 12/1999 |
| WO | WO 97 49613 | 12/1997 |
| WO | WO 02/06128 | 1/2002 |
| WO | WO 02/034630 | 5/2002 |

* cited by examiner

COLLAPSIBLE CONTAINER

BACKGROUND OF THE INVENTION

The present invention relates generally to collapsible crates, and more particularly, to a collapsible crate with an improved hinge.

Molded plastic collapsible crates are known. Four side walls are each connected via a hinge to a base. The side walls are selectively movable about the hinge between a use position generally perpendicular to the base and a collapsed position on the base. Adjacent walls are connected at the corners using any of a variety of methods to selectively lock the crate in the use position. The side walls are moved to the collapsed position to save space when not in use.

SUMMARY OF THE INVENTION

The present invention provides a collapsible crate with an improved hinge that facilitates assembly of the side walls to the base and provides a secure attachment of the side wall to the base.

Generally, the collapsible crate includes a base to which at least one side wall is connected by at least one improved hinge. Each hinge comprises a hinge member and a hinge receiver. The hinge receiver includes at least one deformable tang having an opening. The hinge member includes a hinge pin having an axial end extending into the opening of the tang. The tang is temporarily deformed as the hinge member is inserted into the hinge receiver and then snaps back as the hinge pin is received within the opening of the tang, thereby capturing the hinge pin in the hinge receiver.

In the preferred embodiment, the hinge receiver comprises two tangs that are deformable outward to permit insertion of the hinge pin into the openings in the tangs. The hinge receiver further includes a concave cradle between the tangs for supporting a cylindrical surface of the hinge pin. Upper, inner surfaces of the openings in the tangs engage a rounded portion of an upper surface of each axial end of the hinge pin. Each axial end of the hinge pin further includes a tapered portion, which facilitates insertion of the hinge pin into the hinge receiver.

BRIEF DESCRIPTION OF THE DRAWINGS

Other advantages of the present invention will be readily appreciated as the same becomes better understood in reference to the following detailed description when considered in connection with the accompanying drawings wherein.

DETAILED DESCRIPTION OF THE PREFERRED EMBODIMENT

Figure 1:
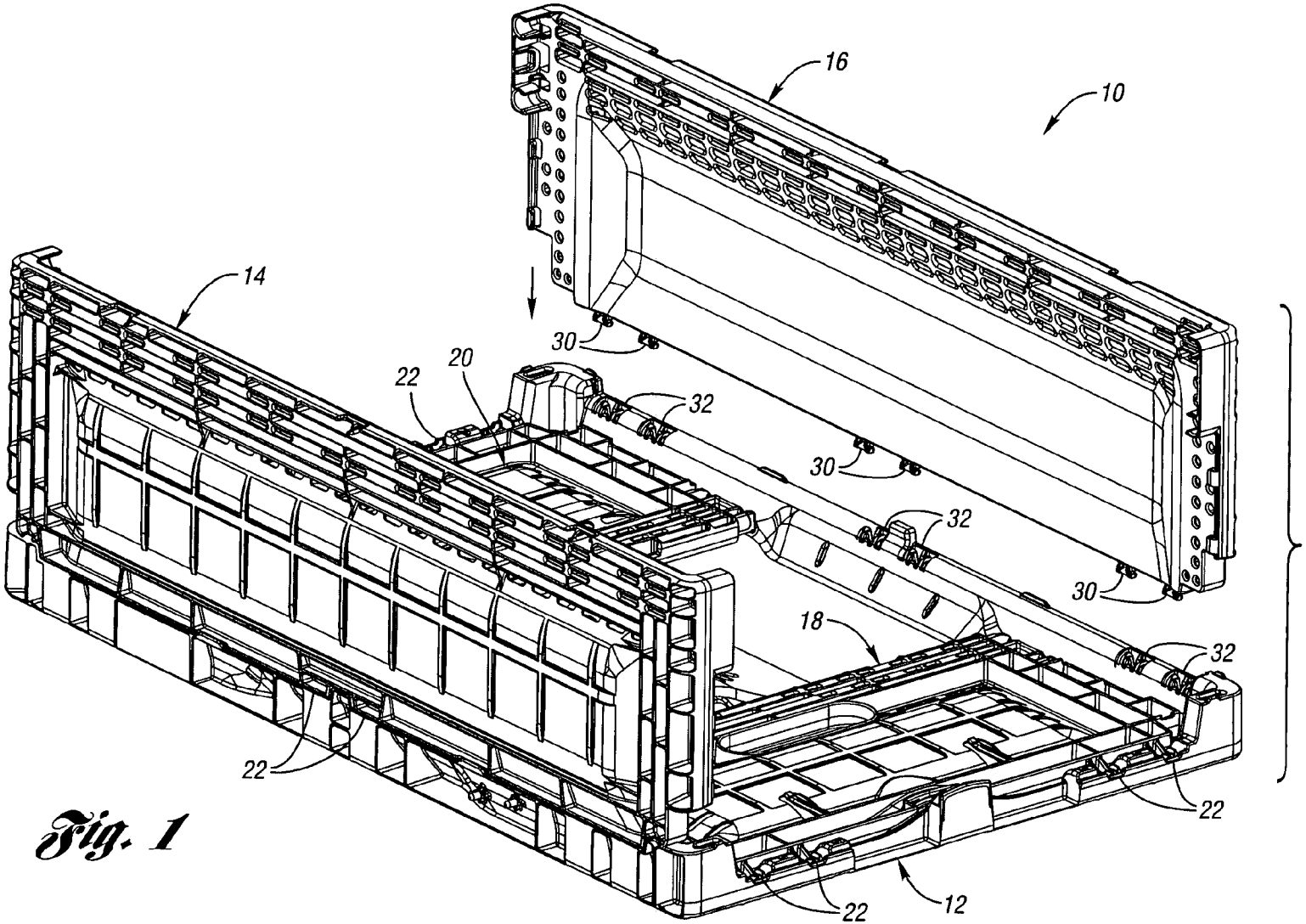
FIG. 1 is a perspective view of a collapsible crate according to the present invention, showing two of the side walls in the collapsed position.

FIG. 1 is a perspective view of a collapsible crate 10 according to the present invention. The crate 10 generally comprises a base 12 and side walls 14, 16, 18 and 20, each connected to the base by a plurality of hinges 22. The side walls 14, 16, 18, 20 are movable about the hinges 22 between a use position and a collapsed position. In the use position, the side walls are generally perpendicular to the base 12 as demonstrated by side wall 14 in FIG. 1. In the collapsed position, the side walls are generally parallel to the base 12, as demonstrated by side walls 18 and 20 in FIG. 1. In FIG. 1, side wall 16 is shown detached from the base 12.

Figure 2:
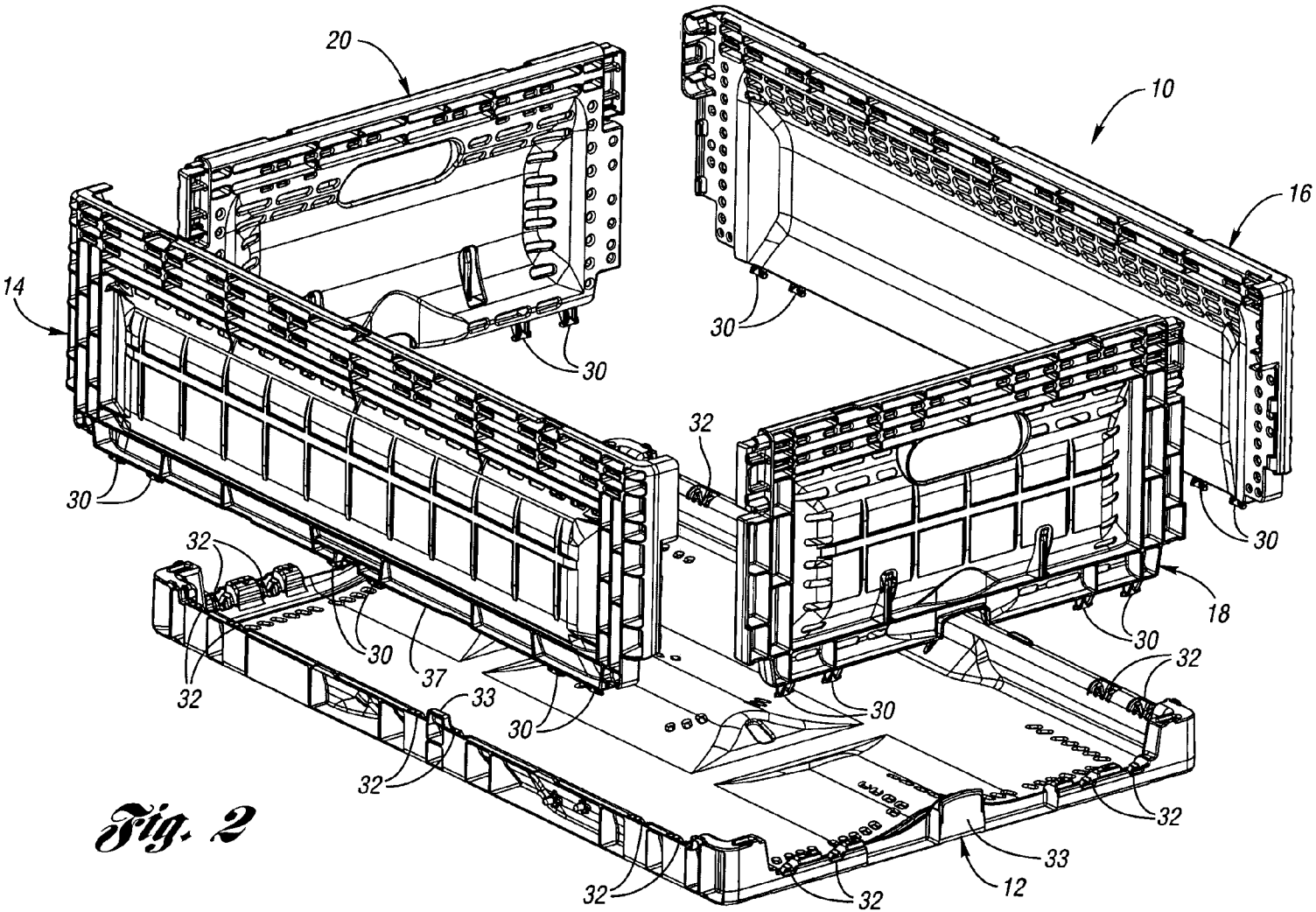
FIG. 2 is an exploded view of the collapsible crate of FIG. 1.

An exploded view of the crate 10 is shown in FIG. 2, where it can be seen that each of the hinges 22 comprises a hinge member 30 and a hinge receiver 32. As shown in FIG. 2, the hinge members 30 are integrally molded with and extend down from a lower edge 37 of each of the side walls 14, 16, 18, 20 and the hinge receivers 32 are integrally molded with and extend upward from the base 12. Alternatively, the hinge members 30 could extend up from the base and the hinge receivers 32 could extend down from the side walls 14, 16, 18, 20.

A stop member 33 extends upwardly from a peripheral edge of the base 12 adjacent each of the side walls 14, 16, 18, 20. The stop member 33 is for abutting an outer surface of each of the side walls 14, 16, 18, 20 when in the use position to provide additional support.

Figure 3:
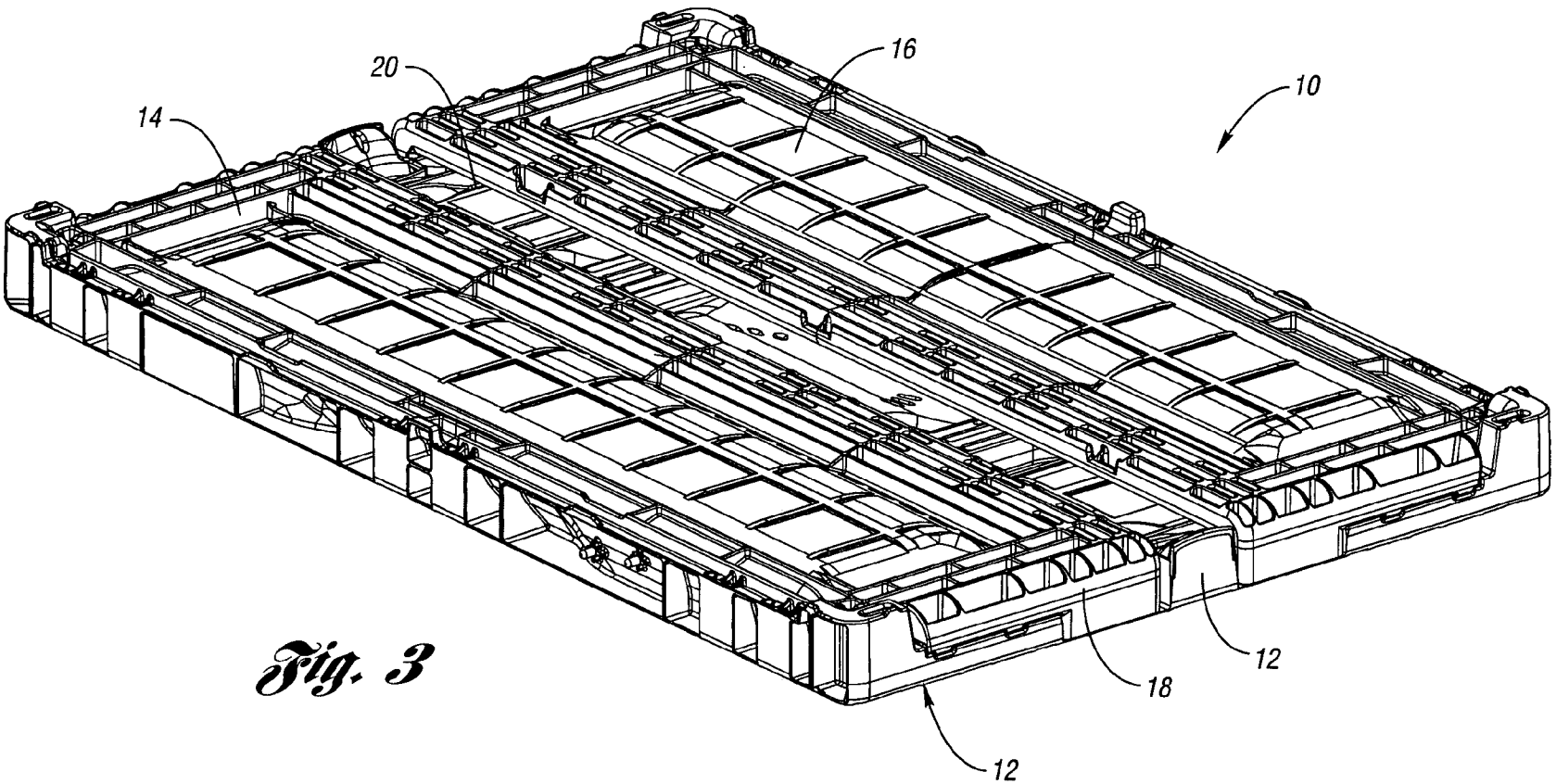
FIG. 3 is a perspective view of the collapsible crate of FIG. 1 in the collapsed position.

During transport or storage, the crate 10 can be folded to the collapsed position as shown in FIG. 3, where the side walls 18 and 20 are folded onto the base 12. The side walls 14, 16 are then folded onto the side walls 18, 20 as shown. Alternatively, side walls 14, 16 could be collapsed onto the base 12 and side walls 18, 20 onto side walls 14, 16.

Figure 4:
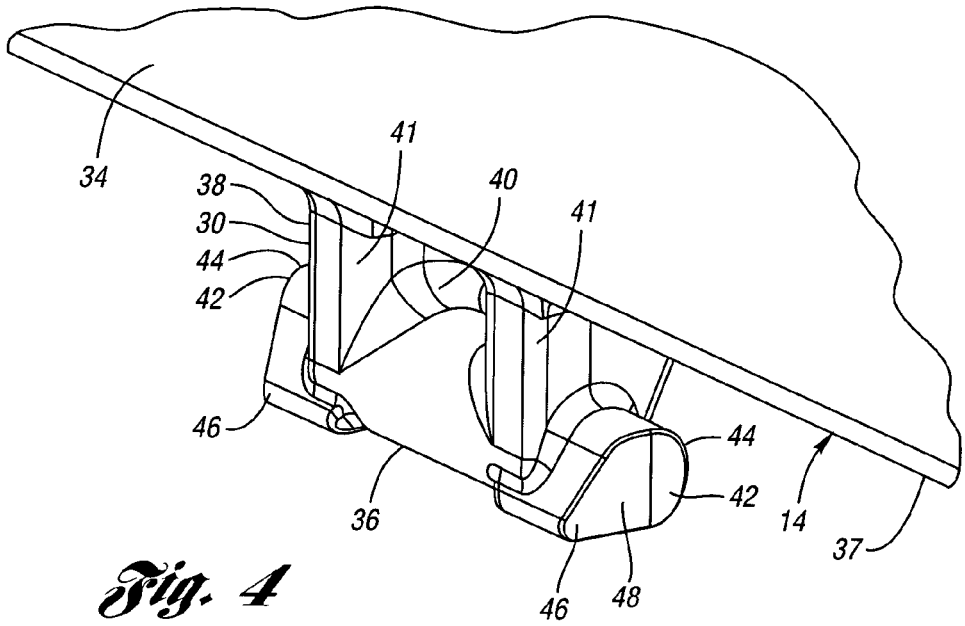
FIG. 4 is an enlarged perspective view of one of the hinge members.

FIG. 4 is an enlarged perspective view of one of the hinge members 30 on side wall 14, as viewed from an inner surface 34 of side wall 14. The other hinge members 30 on the other side walls 16, 18, 20 are identical or substantially similar.

Figure 5:
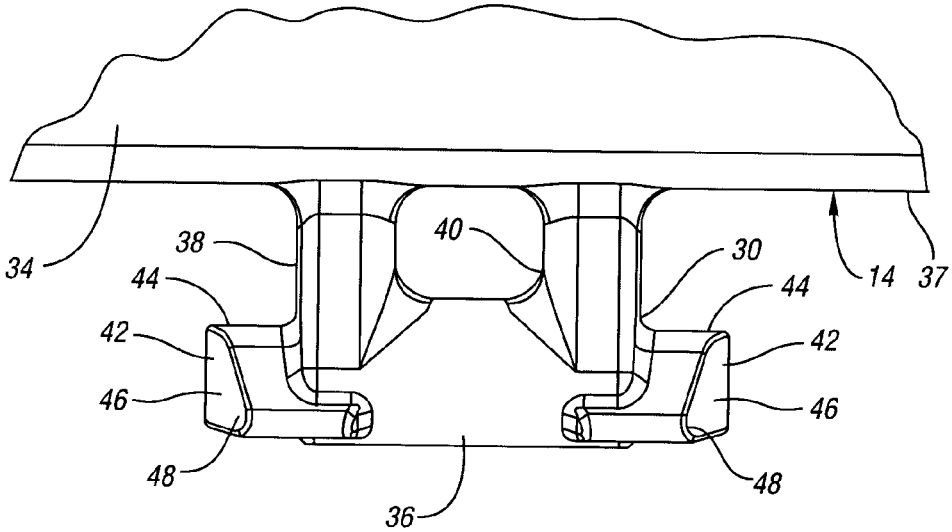
FIG. 5 is an elevational view of the hinge member of FIG. 4.

Referring to FIGS. 4 and 5, the hinge member 30 includes a hinge pin body 36 secured to a lower edge 37 of the side wall 14 via a base 38. An opening 40 is formed generally in the center of the base 38 of the hinge member 30 to define a pair of supports 41 connecting the hinge pin body 36 to the lower edge 37 of the side wall 14. Axial ends 42 of the hinge pin body 36 protrude outwardly of the supports 41. Each axial end 42 includes a rounded portion 44 formed on a portion of the circumferential surface of the axial end 42. The rounded portion 44 is positioned toward the outside of the crate when the side wall 14 is in the upright position. Each axial end 42 further includes a tapered portion 46 on the circumferential surface of the axial end 42. The tapered portion 46 is positioned toward the inside of the crate 10 when the side wall 14 is in the upright position and toward the base 12 when in the collapsed position for assembly. The tapered portion 46 is tapered in two directions. The tapered portion 46 of the axial end 42 has a reduced diameter compared to the rounded portion 44 and is also tapered axially, i.e. the hinge pin body 36 is shorter in the axial direction at the tapered portion 46 than at the rounded portion 44, thus defining a tapered axial surface 48 on each axial end 42.

Figure 6:
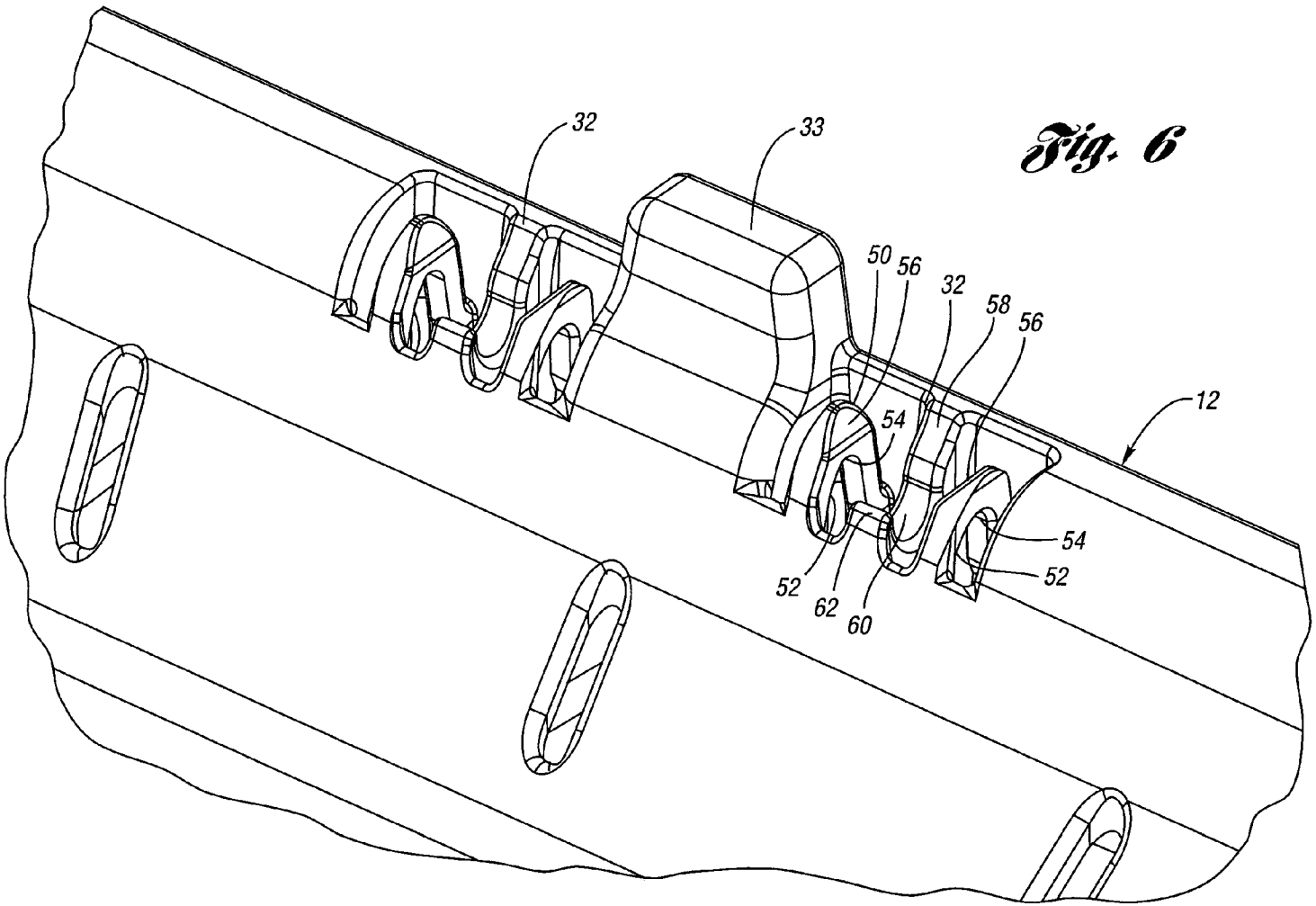
FIG. 6 is an enlarged perspective view of two hinge receivers.

FIG. 6 is a perspective view of the interior of the base 12 showing two hinge receivers 32, positioned on either side of a stop member 33. Each hinge receiver 32 includes a pair of opposed, deformable tangs 50 each having a central opening 52. Each opening includes a rounded upper surface 54. Each tang 50 further includes a tapered surface 56 on an upper edge of each tang 50. A generally concave cradle 58 is defined between the pair of tangs 50 and includes a concave, rounded surface 60 extending to a foot portion 62 that protrudes upwardly between the tangs 50.

Figure 7:
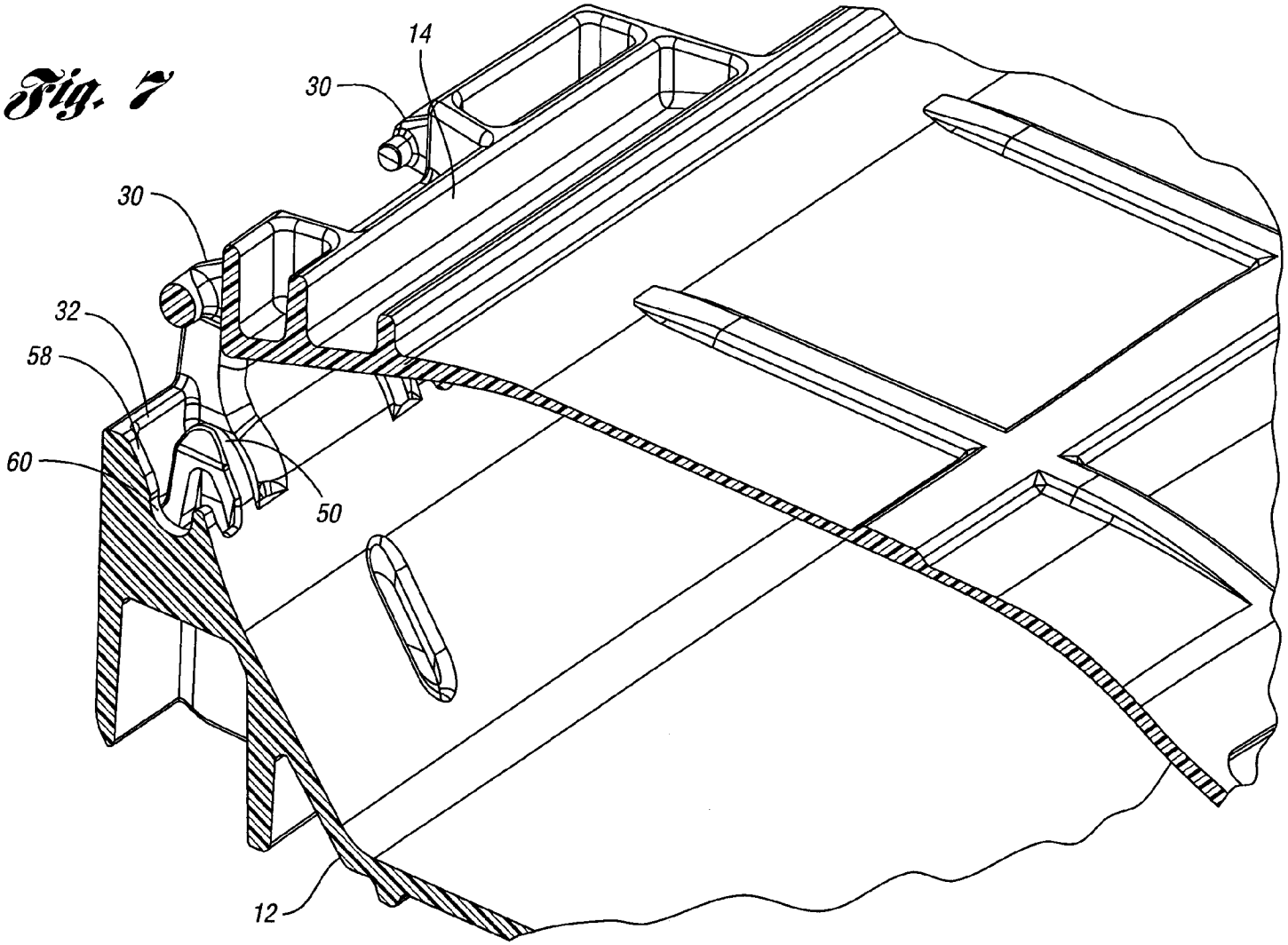
FIG. 7 is a perspective, exploded, section view of the base and one of the side walls of the collapsible crate in a position for assembly.

FIG. 7 is an interior perspective enlarged section view of the side wall 14 and base 12 in a position for assembly. As shown in FIG. 7, the side wall 14 is rotated to a position generally parallel to the base 12 and the hinge members 30 on the side wall 14 are aligned with the hinge receivers 32 on the base 12.

Figure 8:
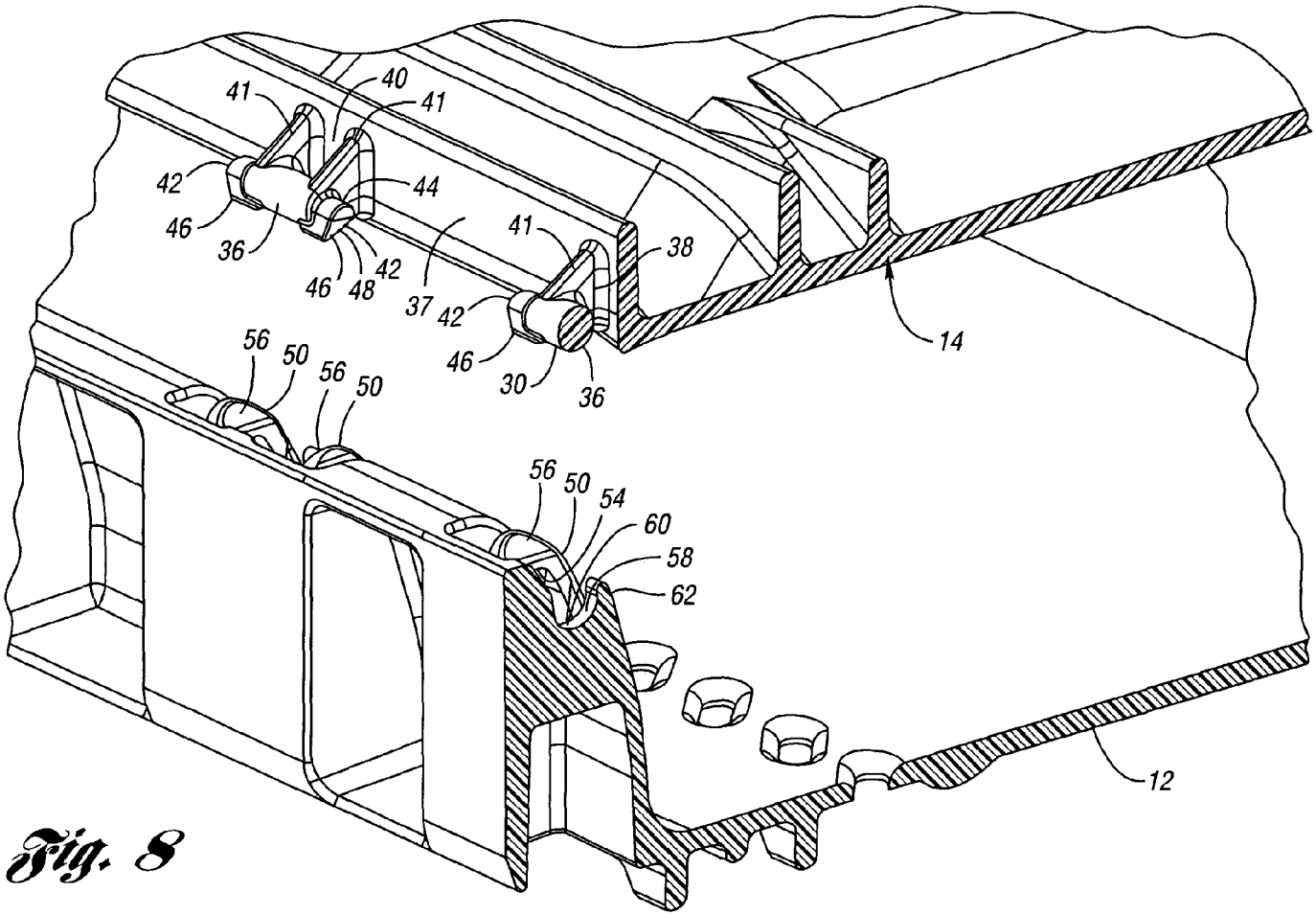
FIG. 8 is an enlarged view of a portion of the side wall and base of FIG. 7.

FIG. 8 is an exterior perspective view of two of the hinge members 30 and hinge receivers 32 of FIG. 7. In this orientation, the tapered portions 46 of the axial ends 42 of the hinge members 30 are aligned with the tapered surfaces 56 of the tangs 50. In this orientation, the hinge members 30 are then inserted into the hinge receivers 32. Tapered axial surfaces 48 of each of the hinge members 30 contacts the tapered surface 56 of each tang, which is consequently deflected outwardly to permit full insertion of the hinge pin 30 into the hinge receiver. When the rounded portion 44 of each axial end 42 of the hinge members 30 travel past the tapered surface 56 of the tangs 50, each axial end 42 snaps into an opening 52 in one of the tangs 50, thereby locking each hinge member 30 into a hinge receiver 32.

Figure 9:
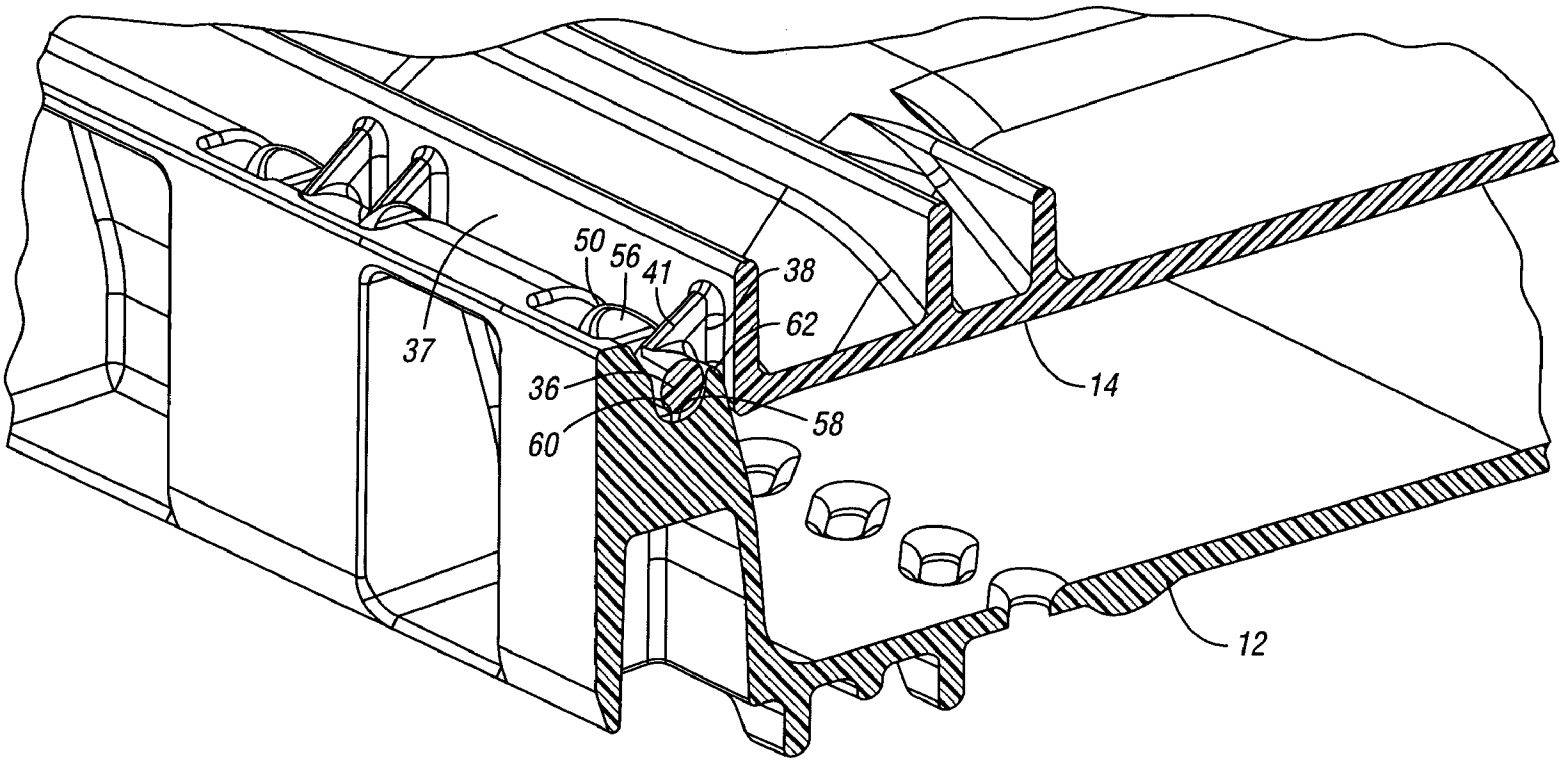
FIG. 9 is the base and side wall of FIG. 8 in the assembled, collapsed position.
Figure 10:
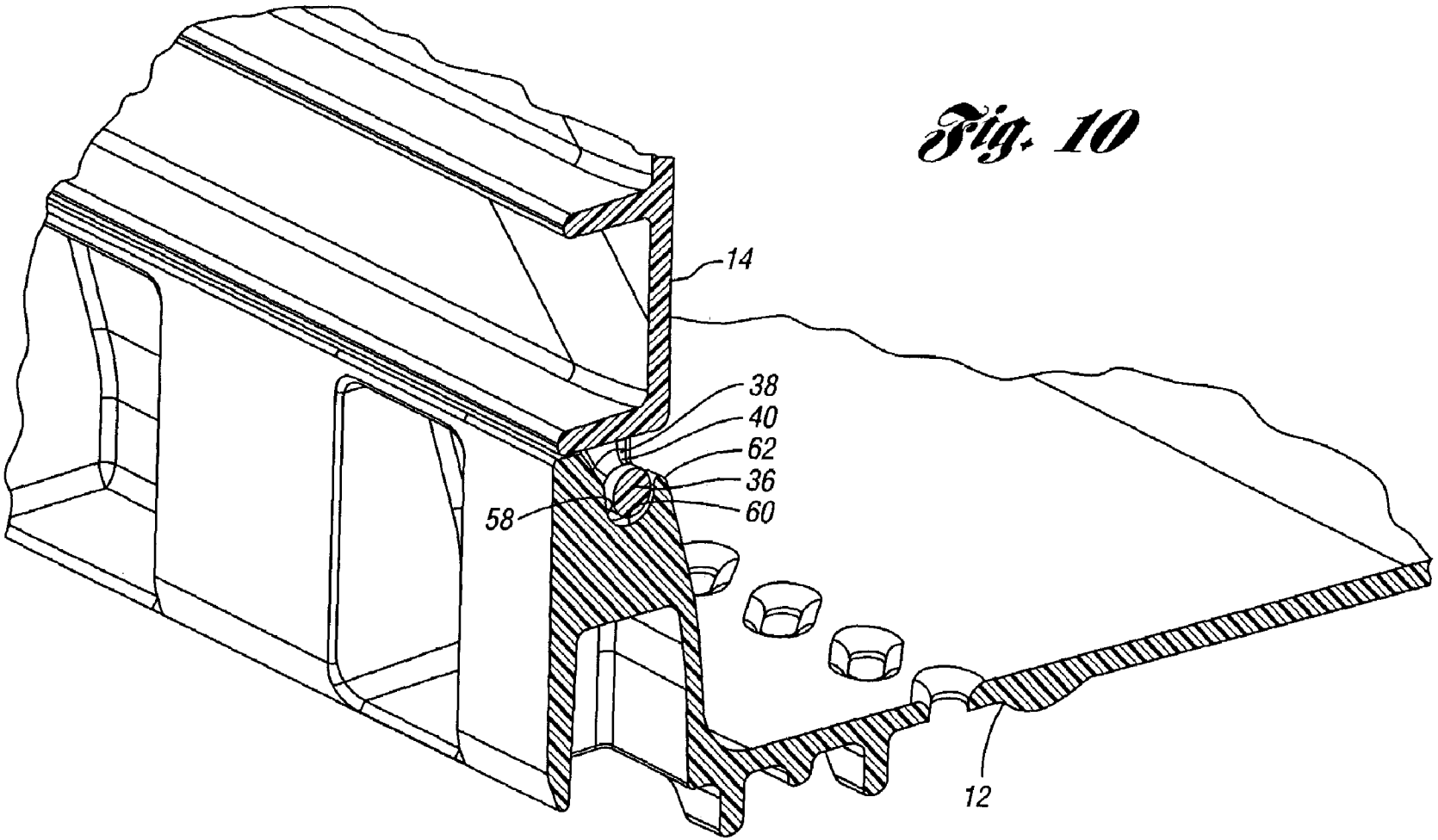
FIG. 10 is the base and side wall of FIG. 9 in the upright position.

In this position, shown in FIG. 9, the generally cylindrical surface of the hinge pin body 36 rests on the generally rounded concave surface 60 of the cradle 58 while the rounded portion 44 of each axial end 42 of the hinge member engages the rounded surface 54 of its associated opening 52 in the tang 50. This assembly thereby provides a hinge about which the side wall 14 can pivot between from its fully collapsed position generally parallel to base 12 as shown in FIG. 9 to its use position, generally perpendicular to base 12, as shown in FIG. 10. The cradle 58 also provides downward support for the hinge pin body 36 to decrease the possibility for hinge pin body 36 deflection under a compressive load.

Figure 11:
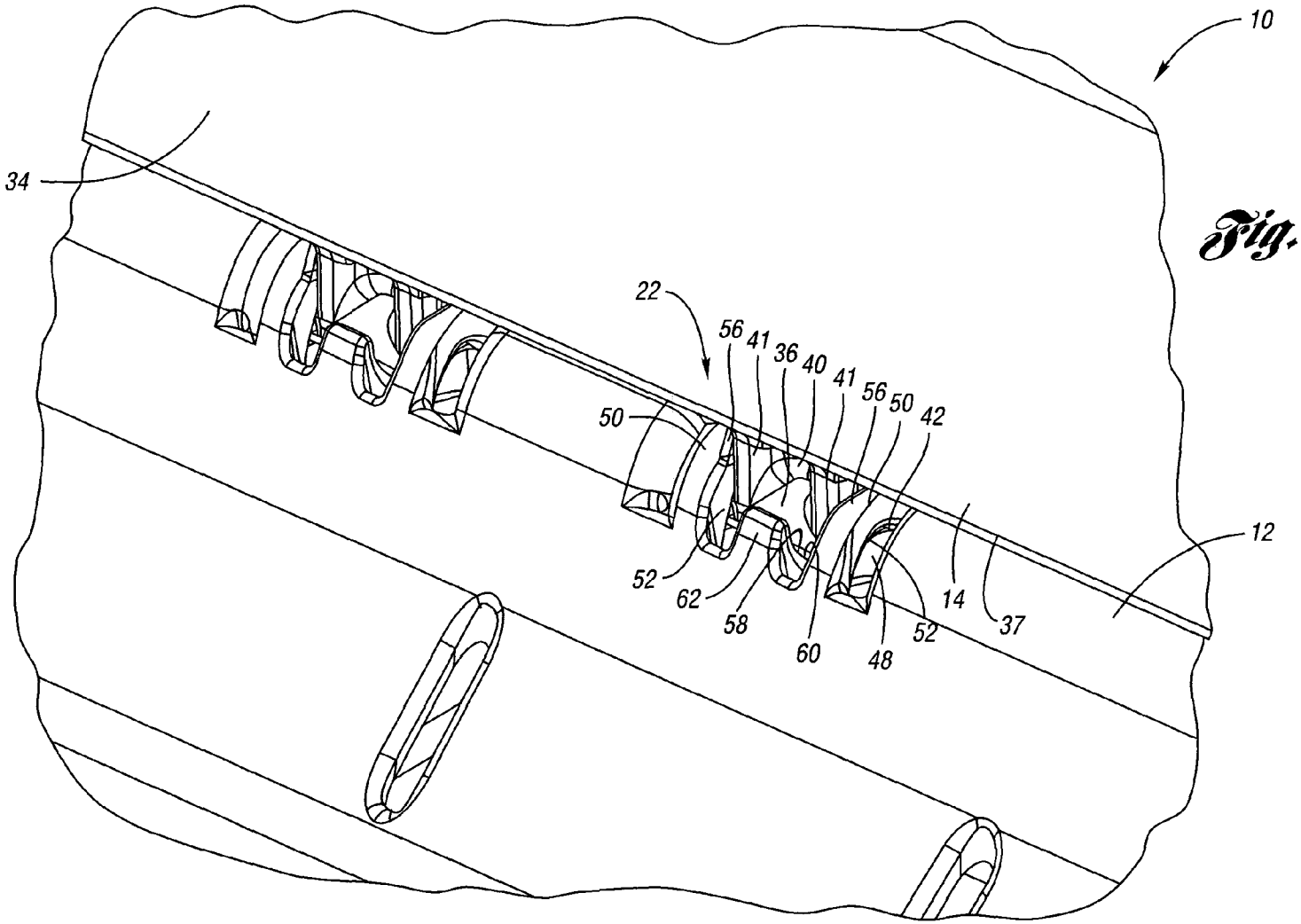
FIG. 11 is a perspective, enlarged, interior view of the hinge members assembled into the hinge receivers.

FIG. 11 is a perspective view of the assembled hinge 22 from the interior of crate 10. As can be seen in FIG. 11, the axial ends 42 are received within the openings 52 of the tangs 50. The hinge pin body 36 supported in the cradle 58 on the concave surface 60 which extends around the cylindrical surface of the hinge pin body 36 approximately 180°. The foot portion 62 of the cradle 58 is aligned with and received within the opening 40 in the base 38 of the hinge member 30.

The hinge 22 of the present invention provides easy assembly of the side walls 14, 16, 18, and 20 to the base 12 and provides a secure attachment of the side walls 14, 16, 18 and 20 to the base 12.

Each of the base 12 and side walls 14, 16, 18, 20 of the collapsible crate 10 of the present invention is preferably formed in one piece of polypropylene via an injection molding process, but of course can be formed of any type of plastic applicable for the desired use. While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. There are many different configurations for collapsible crates and many variations in design, many of which would benefit from the present invention.

What is claimed is:

1. A collapsible crate comprising:

a base;

a plurality of side walls including a first side wall; and a hinge connecting the base to the first side wall, the hinge comprising a hinge member and a hinge receiver, the hinge receiver having a tang extending a length from the hinge receiver, the length greater than a maximum thickness of the tang, the tang including an opening into the thickness of the tang, the binge member including a hinge pin extending into the opening of the tang, the hinge pin including a first axial end and a second axial end, the first axial end having a circumference including a rounded portion and a tapered portion.

2. The collapsible crate of claim 1 wherein the tang is selectively deformable outward to permit insertion of the hinge pin into the opening of the tang.

3. The collapsible crate of claim 2 wherein the tang is one of a pair of tangs, the tangs deformable away from each other during insertion of the hinge pin into the hinge receiver until the hinge pin snaps into the openings in the tangs.

4. The collapsible crate of claim 3 wherein the first side wall is movable about the hinge between a collapsed position generally parallel to the base and a use position generally perpendicular to the base.

5. The collapsible crate of claim 4 further including a plurality of the hinges connecting the first side wall to the base.

6. The collapsible crate of claim 5 wherein the second axial end has a circumference including a rounded portion and a tapered portion.

7. The collapsible crate of claim 6 wherein each tapered portion has a reduced diameter.

8. The collapsible crate of claim 7 wherein the tapered portions of the first and second ends of the hinge pin are tapered axially.

9. The collapsible crate of claim 8 wherein the hinge receiver includes a cradle disposed adjacent the pair of tangs.

10. The collapsible crate of claim 9 wherein the cradle is a concave surface extending circumferentially approximately 180 degrees.

11. The collapsible crate of claim 10 wherein the cradle extends to a foot portion projecting upward from the hinge receiver and received within a recess on the hinge member when the first side wall is pivoted about the hinge to a collapsed position.

12. The collapsible crate of claim 11 wherein the hinge pin includes a body portion between the first and second axial ends, the body portion including a generally cylindrical outer surface abutting the cradle of the hinge receiver.

13. The collapsible crate of claim 12 wherein each tang includes a generally rounded surface abutting the rounded portion of the first axial end of the hinge pin.

14. The coilapsible crate of claim 1 wherein the tang is one of two tangs and wherein first and second axial ends of the hinge pin are received within the openings of the tangs.

15. The collapsible crate of claim 1 wherein the tang includes a free outer end and an inner end secured to the hinge receiver, the opening defined between the outer end and the inner end.

16. The collapsible crate of claim 15 wherein the outer end of the tang includes a tapered surface.

17. The collapsible crate of claim 1 wherein the tang extends generally away from the hinge receiver, the tang deflecting away from the hinge pin as the hinge pin is moved toward the hinge receiver.

18. The collapsible crate of claim 1 wherein the tang is selectively bendable outward to permit insertion of the hinge pin into the opening of the tang.

19. The collapsible crate of claim 18 wherein the tang is one of a pair of tangs, the tangs bendable away from each other during insertion of the hinge pin into the hinge receiver until the hinge pin snaps into the openings in the tangs.

20. The collapsible crate of claim 19 wherein height of the tang is substantially greater than the maximum thickness of the tang.

21. The collapsible crate of claim 20 wherein an inner surface of an outer axial end of one of the tangs is angled outwardly away from the other of the tangs.

22. The collapsible crate of claim 1 wherein the tang extends from a base portion adjacent the receiver to an outer axial end, the outer axial end of the tang having a reduced thickness less than a base thickness of the tang at the base portion.

23. A collapsible crate comprising:

a base; and a plurality of side walls including a first side wall one of the base and the first side wall including a hinge member, the other including a hinge receiver, the hinge member including a hinge pin having a first axial end having a circumference including a tapered portion, wherein the tapered portion of the first axial end is tapered axially such that the hinge pin is shorter axially on an interior portion of the hinge pin than on an exterior portion of the hinge pin when the side wall is in the upright position, the hinge receiver having at least one tang having an opening for receiving the hinge pin of the hinge member, the at least one tang being deformable outwardly to receive the hinge pin, the first axial end of the hinge pin extending into the opening of the at least one tang.

24. The collapsible crate of claim 23 wherein the at least one tang is deformable in a direction generally parallel to an axis of rotation of the hinge member.

25. The collapsible crate of claim 23 wherein the at least one tang includes a pair of tangs, the tangs deformable away from each other during insertion of the hinge pin into the hinge receiver until the hinge pin snaps into the openings in the tangs.

26. The collapsible crate of claim 25 wherein the hinge pin includes the first axial end and a second axial end, each having a circumference including a rounded portion and the tapered portion.

27. The collapsible crate of claim 26 wherein the tapered portion has a reduced diameter.

28. The collapsible crate of claim 26 wherein the tapered portion of the second end of the hinge pin is tapered axially.

29. The collapsible crate of claim 23 wherein the hinge receiver includes a cradle disposed between the two tangs.

30. The collapsible crate of claim 29 wherein the cradle is a concave surface opening upward and extending circumferentially approximately 180 degrees.

31. The collapsible crate of claim 30 wherein the hinge pin includes a body portion between the first axial end and a second axial end, the body portion including a generally cylindrical outer surface for abutting the cradle of the hinge receiver.

32. The collapsible crate of claim 31 wherein the at least one tang includes a generally rounded surface for abutting the rounded portion of the first axial end of the hinge pin.

33. The collapsible crate of claim 32 wherein the first axial end and the second axial end of the hinge pin each have a tapered portion, wherein the hinge member is disposed on the first side wall and wherein the tapered portions are aligned with the tangs on the hinge receiver when the first side wall is oriented generally parallel to the base.

34. The collapsible crate of claim 23 wherein the opening is formed through the at least one tang.

35. A collapsible crate comprising:

a base; and a plurality of side walls each movable about a hinge between a collapsed position generally parallel to the base and a use position generally perpendicular to the base, each hinge comprising a hinge member and a hinge receiver, the hinge member including a hinge pin including opposite axial ends, the hinge receiver having a pair of tangs each having an opening, the tangs bendable outwardly upon insertion of the hinge pin into the hinge receiver and snapping back onto the hinge pins once the axial ends of the hinge pin are received in the openings in the tangs, each tang at least substantially circumscribing the corresponding opening and each tang at least substantially circumscribing the axial end received in the opening in the tang wherein an inner surface of an outer end of one of the tangs is angled outwardly away from the other of the tangs.

36. A collapsible crate comprising:

a base; and a plurality of side walls including a first side wall, one of the base and the first side wall including a hinge member, the other including a hinge receiver, the hinge member including a hinge pin, the hinge receiver having at least one tang having an opening extending through the at least one tang, the opening for receiving the hinge pin of the hinge member, wherein the hinge pin includes a first axial end having a circumference including a rounded portion and a tapered portion, the tapered portion having a smaller diameter than a diameter of the rounded portion, the at least one tang being deformable outwardly to receive the hinge pin, wherein the at least one tang includes a generally rounded surface for abutting the rounded portion of the first axial end of the hinge pin.

37. The collapsible crate of claim 36 wherein the generally rounded surface on the at least one tang is adjacent the opening.

38. A collapsible crate comprising:

a base; and a plurality of side walls including a first side wall one of the base and the first side wall including a hinge member, the other including a hinge receiver, the hinge member including a hinge pin, the hinge receiver having at least one cantilevered tang having an opening through a thickness of the tang for receiving the hinge pin of the hinge member, the at least one tang having an inner end secured to the hinge receiver and a free end extending away from the hinge receiver wherein the thickness of the tang at the free end is less than the thickness of the tang at the inner end, the at least one tang being bendable outwardly to receive the hinge pin.

39. The collapsible crate of claim 38 wherein the free end of the at least one tang extends away from the one of the base and the first side wall.

40. A collapsible crate comprising:

a base;

a plurality of side walls including a first side wall; and a hinge connecting the base to the first side wall, the hinge comprising a hinge member and a hinge receiver, the hinge receiver having a pair of tangs, each tang having an opening into the tang, the hinge receiver including a concave cradle disposed adjacent the pair of tangs, the hinge member including a hinge pin extending into the opening of the tang, at least one of the tangs deformable away from the other during insertion of the hinge pin into the hinge receiver until the hinge pin snaps into the openings in the tangs.

41. A collapsible crate comprising:

a base; and a plurality of side walls including a first side wall, one of the base and the first side wall including a hinge member, the other including a hinge receiver, the hinge member including a hinge pin, the hinge receiver having at least one tang having an opening for receiving the hinge pin of the hinge member, wherein the hinge pin includes a first axial end having a circumference including a rounded portion and a tapered portion, the tapered portion having a smaller diameter than a diameter of the rounded portion, the at least one tang being deformable outwardly to receive the hinge pin, wherein the tapered portion is also tapered axially, such that the hinge pin has a shorter axial length at the tapered portion than at the rounded portion, wherein the at least one tang includes a generally rounded surface for abutting the rounded portion of the first axial end of the hinge pin.

* * * * *